United States Patent [19]

Aoshika

[11] Patent Number: 5,020,296

[45] **Date of Patent: * Jun. 4, 1991**

[54] METHOD OF SECURING LIGHTING FIXTURE

[75] Inventor: Takayuki Aoshika, Tokyo, Japan

[73] Assignee: Ultima Ltd., Tokyo, Japan

[ * ] Notice: The portion of the term of this patent subsequent to Mar. 12, 2008 has been disclaimed.

[21] Appl. No.: 405,797

[22] Filed: Sep. 11, 1989

[30] Foreign Application Priority Data

Sep. 13, 1988 [JP] Japan ..... 63-227573

[51] Int. Cl.[5] ..... F21S 1/02; E04F 19/00; E04G 21/00

[52] U.S. Cl. ..... 52/741; 52/28; 29/433; 29/464; 362/147

[58] Field of Search ..... 52/741, 28; 362/147, 362/145, 147–148, 277, 285, 364–365, 368, 372, 404, 406; 29/433, 464

[56] References Cited

U.S. PATENT DOCUMENTS

| | | | |
|---|---|---|---|
| 2,762,598 | 9/1956 | Runge | 362/404 |
| 3,309,755 | 3/1967 | Croucher | 29/433 X |
| 3,512,743 | 5/1970 | Lipscomb | 362/404 |
| 3,859,770 | 1/1975 | Chambers et al. | 52/741 |
| 3,965,624 | 6/1976 | Madonna | 52/741 X |
| 4,083,532 | 4/1978 | Pola | 29/433 X |
| 4,096,964 | 6/1978 | Glick | 52/741 X |
| 4,215,456 | 8/1980 | Buunk et al. | 29/433 X |
| 4,327,402 | 4/1982 | Aubrey | 362/285 |
| 4,595,969 | 6/1986 | McNair | 362/285 |

FOREIGN PATENT DOCUMENTS

| | | | |
|---|---|---|---|
| 163321 | 6/1989 | Japan | 52/741 |
| 642776 | 1/1979 | U.S.S.R. | 29/433 |

*Primary Examiner*—John E. Murtagh
*Assistant Examiner*—Deborah McGann Ripley
*Attorney, Agent, or Firm*—Jordan and Hamburg

[57] ABSTRACT

A method of fixedly securing an lighting fixture to a ceiling of a building structure, comprises a first securing step for securing an anchor grip at a prescribed position on a bottom face of a slab of the building structure, a flexible suspender being inserted through the anchor grip; a second securing step for securing a suspender grasping assembly temporarily to a lighting fixture support member; a suspending step for inserting the flexible suspender from the lower free end thereof through the suspender grasping assembly and then raising the suspender grasping assembly along the flexible suspender, while the lighting fixture support member is temporarily fixed to a temporary set position on the suspender; an adjusting step for adjusting height of the lighting fixture support member to fit into a ceiling finish board, by moving the suspender grasping assembly along the flexible suspender together with the lighting fixture member; and a fixing step for fixing the lighting fixture support member to the flexible suspender at the height as adjusted by the adjusting step.

5 Claims, 2 Drawing Sheets

METHOD OF SECURING LIGHTING FIXTURE

BACKGROUND OF THE INVENTION

. Field of the Invention

The present invention relates to a method of securing an illumination or lighting fixture to the ceiling of a room by suspending the same from a slab of a building structure.

2. Prior Art Statement

In order to fixedly securing secure lighting fixtures in office and other buildings, there has hitherfore been employed a method wherein lighting fixtures are suspended from a slab of the building while using bolts and nuts for fixing the lighting fixtures at desired heights. In this known method, a straight bolt is cut to have a length measured to extend from the surface of the ceiling finish board to the slab, applied with rustproof treatment and then secured to the slab. A guide assembly having a chain for raising a support plate or housing for the lighting fixture is then attached to the bolt, followed by adjustment of the height, and then the support plate or housing is raised. After removing the guide assembly, a nut and a washer are fitted on the bolt and then the nut is threaded so that it moves upwards to fix the lighting fixture.

However, this known method has disadvantages in that a cumbersome and dangerous operation is necessary for fixing the lighting fixture resulting in reduction in operation efficiency, since the relatively heavy lighting fixture, must be supported by the hands of at least two workers' hands who are staying on high stepladders and the lighting fixture must be raised and lowered by them to adjust the height of the lighting fixture so that it is snugly fitted over an opening of the ceiling finish board. The known method has a further problem that an additional anchor must be driven in the slab at a different position in a case where there is a gap between the existing anchor for suspending the bolt from the slab and the opening of the ceiling finish board.

OBJECTS AND SUMMARY OF THE INVENTION

An object of this invention is to overcome the disadvantages of the known method and to provide a novel method of fixedly securing an a lighting fixture safely and rapidly, in which a flexible suspender member, such as a metal wire or cable, is used in place of the straight bolt used in the conventional method.

In order to achieve the aforementioned object, the present invention provides, a method of fixedly securing a lighting fixture to a ceiling of a building structure comprising:

- a first securing step for securing an anchor grip at a prescribed position on a bottom face of a slab of the building structure, a flexible suspender being inserted through the anchor grip;
- a second securing step for securing a suspender grasping assembly temporarily to a lighting fixture support member;
- a suspending step for inserting the flexible suspender from the lower free end thereof through the suspender grasping assembly and then raising the suspender grasping assembly along the flexible suspender, while the lighting fixture support member is temporarily fixed to a temporary set position on the suspender;

- an adjusting step for adjusting height of the fixture support member to fit into a ceiling finish board, by moving the suspender grasping assembly along the flexible suspender together with the lighting fixture support member; and
- a fixing step for fixing the lighting support member to the flexible suspender at the height as adjusted by the adjusting step.

DESCRIPTION OF PREFERRED EMBODIMENTS

Referring to the appended drawings, a presently preferred embodiment of this invention will now be described in detail.

Figure 1:
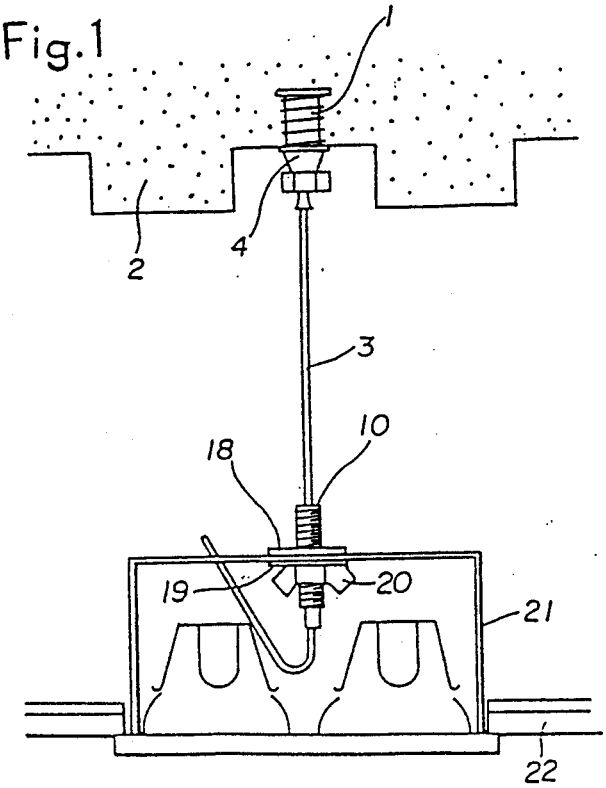
FIG. 1 is a partially sectional view showing an a lighting fixture which is supported by a support member fixedly suspended a slab of a building structure according to the method of this invention.
Figure 2:
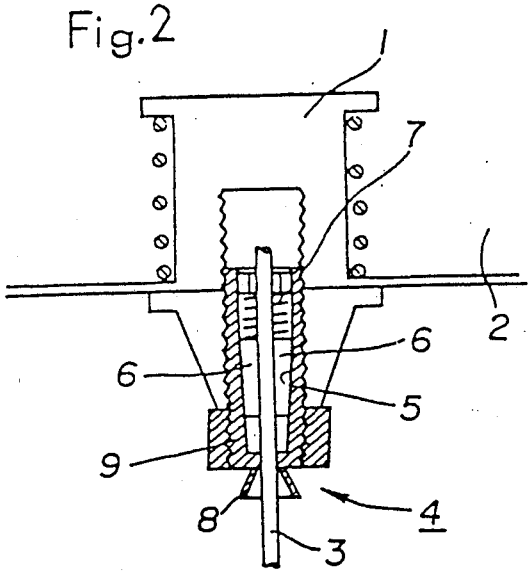
FIG. 2 is a sectional view showing the detailed construction of an anchor grip used in an embodiment of this invention.

FIG. 1 shows an embodiment of a system, for securing a lighting fixture. As shown in FIG. 1, an insert or anchor 1 is driven into a slab 2 of a building structure, and an anchor grip 4 is screw fitted to the anchor 1. One end of a wire 3 serving as a flexible suspender is firmly held by the anchor grip 4. As shown in detail in FIG. 2, the anchor grip 4 has a tapered bore 5 converging in the downward direction as viewed in FIG. 2, and plural clamping members 6 each having therein an arcuate recess are snugly contained in the bore 5 of the anchor grip 4. The clamping members 6 are urged downwardly by means of a compression spring 7. The lower end of the bore 5 is communicates with an enlarged wire guide port 8, and a clamp-releasing member 9 is disposed on the lower portion of the anchor grip 4. The end of the wire 3 once inserted from the wire guide port 8 through the recesses of the split clamping members 6 into the bore 5 cannot be drawn off, since the plural clamping members 6 are biased downwardly under the action of the spring 7 so that each of the arcuate segments defined by the inner peripheries of the split clamping members 6 is squeezed to apply a frictional force on the outer periphery of the wire 3. On the contrary, when it is desired to insert one end of the wire 3 into the anchor grip 4, it suffices only to insert the end upwards through the guide port 8, whereupon the clamping members 6 move upwards against the compression force of the spring 7 to enlarge the spacing between the clamping members 6 to ensure easy insertion of the wire 3.

Figure 3:
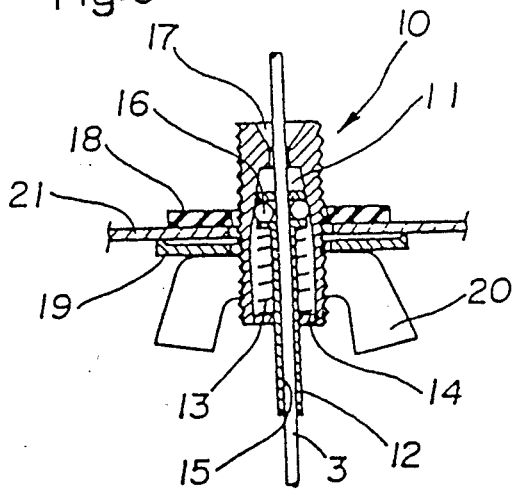
FIG. 3 is a sectional view similar to FIG. 2, showing the detailed construction of a suspender grasping assembly used in an embodiment of this invention.

Referring now to FIG. 3, a suspender grasping assembly 10 receives the other end of the wire 3 and has an upwardly-converging tapered bore 11 within which a slider 12 is contained to move along the vertical direction and is normally biased upwards by a compression spring 13. The lower open end of the bore 11 is closed by a plug 14, the upper surface of which constitutes the lower seat for the spring 13. The slider 12 has a leg portion through which a hollow extension 15 extending in the longitudinal direction of the slider (in the illustrated embodiment, in the vertical direction) is formed, and branches defining ball-containing bores extend from the upper end of the main body (or gripper member) of the slider 12 in the direction perpendicular to the longitudinal direction of the slider 12 to contain balls 16. In the illustrated embodiment, three balls 16 are contained. At the upper end of the grasping assembly 10 provided is an upper guide port 17 which communicates with the bore 11. The lower end of the wire 3 suspended from the slab 2 is inserted through the upper guide port 17 into the bore 11, and passed through the hollow extension 15 of the slider 12 to extend below the slider 12. Upon insertion of the wire 3 into the slider 12, the end of the wire 3 pushes the balls 16 downwards against the biasing force of the spring 13 so that the balls 16 are forced to move in the radially outward direction as the upper branched end of the slider 12 moves downwards along the tapered bore 11 to allow the wire 3 to pass through the hollow extension 15. When the wire 3 comes to a desired position or height and the downward pushing force is released, the spring 13 pushes the slider 12 upwards and the balls 16 are moved inwardly to be in clamping engagement with the outer periphery of the wire 3, whereby the wire 3 is fixed at that position to the suspender grasping assembly 10.

Figure 4:
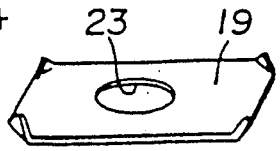
FIG. 4 is a perspective view showing an engaging member to be assembled in the suspender grasping assembly shown in FIG. 3.

Around the suspender grasping assembly 10, fitted are a rubber washer 18 serving as an engaging member, and a metal washer 19 formed with pawls as best seen from FIG. 4. The metal washer 19 serves as means for preventing rotation of a lighting fixture support member 21, and a butterfly nut 20 is screwed onto the outer periphery of the main body of the suspender grasping assembly 10. The pawled washer 19 supported by the butterfly nut 20, in turn, supports the lighting fixture support member 21 having a center hole through which the grasping assembly 10 extends. The lighting fixture support member 21 has an opening which has a shape and dimensions substantially coincident with those of the opening provided through a ceiling finish board 22. As shown in FIG. 4, the pawled washer 19 preferably has a generally elliptical center hole 23. By inserting the main body or gripper member of the suspender grasping assembly 10, which preferably has an outer periphery of generally elliptical contour, the suspender grasping assembly 10 is prevented from rotating relative to the pawled washer 19; and rotation of the lighting fixture support member 21 relative to the pawled washer 19 is also prevented by the pawls provided at four corners of the washer 19.

The operation sequence for securing one or more lighting fixtures, according to this invention, will now be described.

Figure 5:
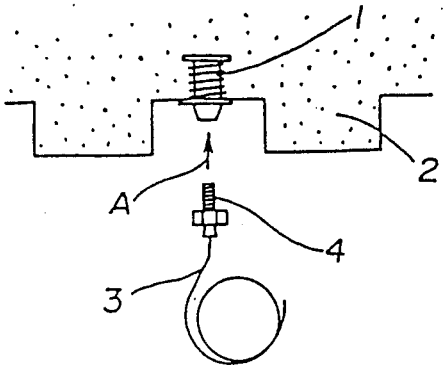
FIGS. 5 to 9 are schematic illustrations showing the operation sequences involved in the practice of the method of this invention.

The anchor or insert 1 is preliminarily anchored into the slab 2, and one end (i.e. upper end) of the wire 3 having a desired length is inserted into the anchor grip 4. Then, the anchor grip 4 is screwed into the female thread of the anchor 1, as shown by the arrow A in FIG. 5, so that the anchor grip is fixed to the anchor 1 (First Securing Step). Alternatively, the anchor grip 4 may be first fixed to the anchor, followed by insertion of the upper end of the wire 3.

Figure 6:
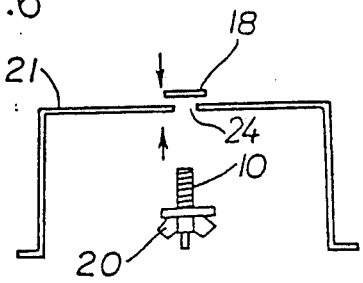

On the other hand, as shown in FIG. 6, the main body or gripper member of the suspender grasping assembly 10, onto which the butterfly nut 20 has been screwed, is inserted through a center holes 24 of the lighting fixtures support member 21, and the suspender grasping assembly 10 is temporarily secured to the lighting fixture support member 21 by means of the rubber washer 18 frictionally engaging with the outer periphery of the suspender gripping assembly 10 (Second Securing Step) so that the lighting fixture support member 21 is not moved downwards during the subsequent operation. This temporary securing (i.e. Second Securing Step) may be carried out in the factory for producing the securing system particularly designed for the practice of this invention.

Figure 7:
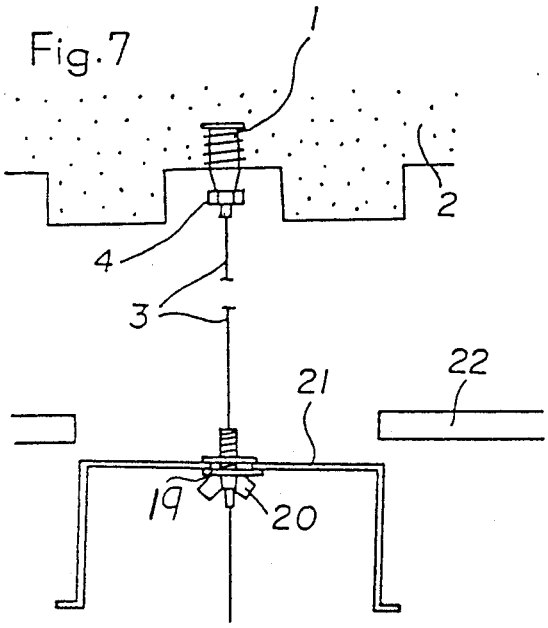

The next step is a step of inserting the lower end of the wire 3 suspended from the anchor grip 4 through the tapered bore 11 of the suspender,,grasping assembly 10 by which the lighting fixture support member 21 is grasped and held at a temporary set position, as shown in FIG. 7. The bottom plate of the lighting fixture support member 21 is now carried by the butterfly nut 20 through the pawled washer 19. The resulting assembly is then raised so that the support member 21 comes near to the opening formed through, the ceiling finish board 22.

Figure 8:
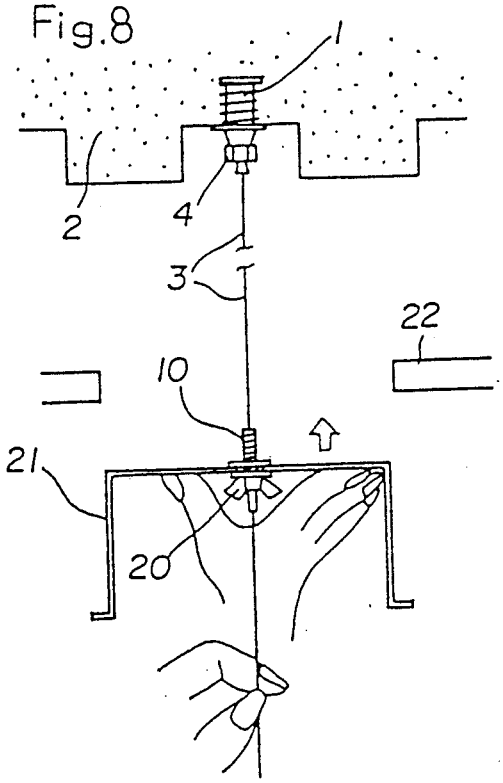
Figure 9:
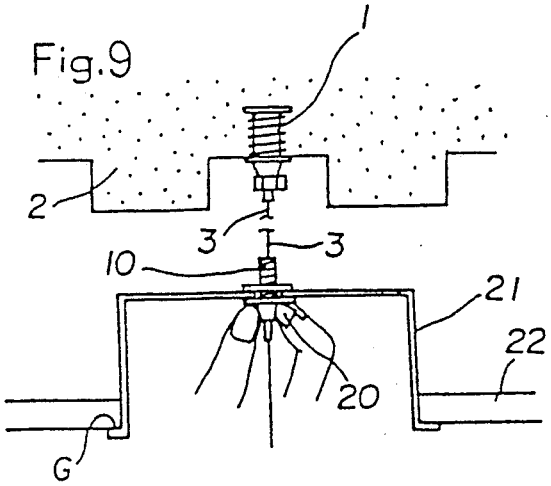

The lighting fixture support member 21, which has been raised to the position vicinal to the opening of the ceiling finish board 22 by the preceding step, is now raised upwards by one hand along the wire 3 while holding the lower end of the wire 3 by the other hand, as shown in FIG. 8, until the opening at the lowest position of the member 21 is substantially flush with (in other words, the whole body of the lighting fixture support member 21 is snugly contained in) the opening formed through the ceiling finish board 22. In case where it is desired to close the gap G (see FIG. 9) perfectly, the member 21 is raised or lowered within a certain limit by, turning the butterfly nut 20 by the fingers of one hand. Thus, the lighting fixture support member 21 is secured fixedly at the appropriate height. The following operation includes for example, incorporation of one or more lighting fixtures within the space defined by the member 21, connection of electrical cables and assemblage of a reflector. However, since this operation is not included as essential features of steps of this invention and is included within ordinary technical knowledge in the art, detailed description thereof will not be given herein.

As has been described hereinbefore, according to the method provided by this invention, a flexible suspender is suspended through an anchor grip which is secured to the anchor head protruding from the under surface of a slab of a building structure, and a suspender grasping assembly is attached to a lighting fixture support member followed by temporary securing of the suspender grasping assembly to a certain desired position intermediately of the flexible suspender. Since it becomes possible to use a flexible suspender, such as a metal cable or wire, cost- and time-consuming operation for positioning the lighting fixture support member in registry with the opening of the pre-formed opening provided through the ceiling is eliminated and the lighting fixture support member can be settled at any desired height in an extremely simplified fashion even if the center axis of the anchor is not aligned with the center of the opening of the ceiling. By the provision of the engaging means which enables temporary holding of the lighting fixture grasping assembly, the subsequent height adjustment and final fixation operation can be carried out simply and safely by one worker. Further provided by this invention are means for preventing relative rotation between the suspender and the suspender grasping assembly and for preventing relative rotation between the suspender grasping assembly and the lighting fixture support member, whereby the height adjustment and final fixation operations can be carried out by one hand of the worker.

Although the invention has been described with reference to a presently preferred embodiment, many modifications and variations may be made in light of the disclosure given above and the appended claims. It is intended to include all such modifications and variations within the scope of the invention which is limited only by the definition recited in the claims.

What is claimed is:

1. A method of fixedly securing a lighting fixture to a ceiling of a building structure, comprising:

a first securing step for securing an anchor grip at a prescribed position on a bottom face of a slab of said building structure, a flexible suspender being inserted through said anchor grip, a second securing step for securing a suspender grasping assembly temporarily to a lighting fixture support member by inserting the grasping assembly through a hole of the support member and holding the assembly by a washer frictionally engaging with an outer periphery of said gripping assembly;

a suspending step for inserting said flexible suspender from the lower free end thereof through said suspender grasping assembly and then raising said suspender grasping assembly along said flexible suspender, while said lighting fixture support member is temporarily fixed to a temporary set position on said suspender;

an adjusting step for adjusting height of said lighting fixture support member to fit into a ceiling finish board, by moving said suspender grasping assembly along said flexible suspender together with said lighting fixture support member; and a fixing step for fixing said lighting fixture support member to said flexible suspender at the height as adjusted by said adjusting step.

2. The method of claim 1, wherein said flexible suspender is a metal wire.

3. The method of claim 1, wherein said flexible suspender is inserted through said anchor grip before said first securing step is carried out.

4. The method of claim 1, wherein said flexible suspender is inserted through said anchor grip after said first securing step is carried out.

5. The method of claim 1 wherein said suspender grasping assembly is held by said washer, a pawled washer and a nut.

* * * * *